US008091615B2

(12) United States Patent
Houfuku et al.

(10) Patent No.: US 8,091,615 B2
(45) Date of Patent: Jan. 10, 2012

(54) HEAT TRANSFER PIPE WITH GROOVED INNER SURFACE

(75) Inventors: Mamoru Houfuku, Inashiki-gun (JP); Ken Horiguchi, Tsuchiura (JP); Kenichi Inui, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 1335 days.

(21) Appl. No.: 11/488,006

(22) Filed: Jul. 18, 2006

(65) Prior Publication Data

US 2007/0089868 A1 Apr. 26, 2007

(30) Foreign Application Priority Data

Oct. 25, 2005 (JP) ..... 2005-309846

(51) Int. Cl.
*F28F 1/36* (2006.01)
*F28F 19/02* (2006.01)

(52) U.S. Cl. ..... 165/133; 165/184

(58) Field of Classification Search ..... 165/133, 165/179, 184; 138/38; *F28F 1/40*
See application file for complete search history.

(56) References Cited

U.S. PATENT DOCUMENTS 3,267,564 A * 8/1966 Keyes ..... 29/890.036
4,657,074 A * 4/1987 Tomita et al. ..... 165/179
4,658,892 A * 4/1987 Shinohara et al. ..... 165/133
5,259,448 A * 11/1993 Masukawa et al. ..... 165/133
5,386,955 A * 2/1995 Savill ..... 244/200
5,655,599 A * 8/1997 Kasprzyk ..... 165/133
5,692,560 A * 12/1997 Messant et al. ..... 165/151
6,056,044 A * 5/2000 Benson et al. ..... 165/104.26
6,173,763 B1 * 1/2001 Sano et al. ..... 165/133
6,298,909 B1 * 10/2001 Fukatami et al. ..... 165/133
6,883,597 B2 * 4/2005 Thors et al. ..... 165/133
7,048,043 B2 * 5/2006 Leterrible et al. ..... 165/184
7,267,166 B2 * 9/2007 Leterrible et al. ..... 165/179
2002/0195233 A1 * 12/2002 Thors et al. ..... 165/133

FOREIGN PATENT DOCUMENTS

JP 01-170880 U 12/1989
JP 7-004884 A 1/1995
JP 2002-350080 A 12/2002
JP 2005-257160 A 9/2005

* cited by examiner

*Primary Examiner* — Tho V Duong
(74) *Attorney, Agent, or Firm* — Foley & Lardner LLP

(57) ABSTRACT

A heat transfer pipe 21 with grooved inner surface is provided with a pipe body 22 having a pipe axis line ○ as a center axis line, a plurality of first fins 23 each having a fin height Hf, formed by providing a plurality of spiral grooves 200 at an inner surface of the pipe body 22 along the pipe axis line ○ and at least a second fin 24 having a fin height hf, provided at a groove bottom of at least one of the spiral groove 200. The fin height hf and a torsion angle α of the second fin 24 are determined respectively to satisfy the following conditions:

$Hf/15 \leqq hf \leqq Hf/3$ and $\alpha=\beta$, when $P=W\times di\times\sin\beta$ and $P\geqq 0.86$ wherein a bottom width of the spiral groove 200 is W, a torsion angle of the spiral groove 200 is β, and an inner diameter of the pipe body 22 is di.

6 Claims, 11 Drawing Sheets

HEAT TRANSFER PIPE WITH GROOVED INNER SURFACE

The present application is based on Japanese Patent Application No. 2005-309846 filed on Oct. 25, 2005, the entire contents of which are incorporated herein by reference.

BACKGROUND OF THE INVENTION

1. Field of the Invention

The present invention relates to a heat transfer pipe with grooved inner surface, more particularly, to a heat transfer pipe with grooved inner surface to be used for the heat exchange by evaporating or condensing for example refrigerant in the pipe.

2. Description of the Related Art

A heat transfer pipe has been used for a heat exchanger used in a refrigerating machine, an air conditioner, a heat pump, etc. In the heat transfer pipe, the heat exchange is conducted by evaporating or condensing the refrigerant provided therethrough.

An inner surface of a conventional heat transfer pipe was flat and smooth at first. However, as the investigation of thermodynamics advances, it is found that the heat transfer coefficient can be improved by forming a predetermined convexo-concave portion at the inner surface of the heat transfer pipe. Recently, the heat transfer pipe with grooved inner surface becomes the mainstream of the heat transfer pipe. The heat transfer pipe with grooved inner surface comprises a heat transfer pipe with an outer diameter of 5 to 9.52 mm, in which grooves with approximately trapezoidal cross section and fins for separating the grooves with approximately triangle cross sections are spirally formed at the inner surface. For example, page 138 of "Compact Heat Exchanger" by Hiroshi Seshimo discloses such a type of the heat transfer pipe with grooved inner surface.

FIGS. 1A to 1C are schematic illustrations showing a conventional heat transfer pipe for in-pipe evaporation/condensation (heat transfer pipe with grooved inner surface), wherein FIG. 1A is a cross sectional view of the heat transfer pipe including a pipe axis line (virtual axis), FIG. 1B is a cross sectional view of the heat transfer pipe cut along a line perpendicular to the pipe axis line, and FIG. 1C is an enlarged cross sectional view showing a part A shown in FIG. 1B. In FIGS. 1A to 1C, H is a fin height, β is an angle with respect to the pipe axis line (torsion angle), and W is a bottom width of the groove. A heat transfer pipe 1 with grooved inner surface comprises a pipe body 2 in which continuous spiral grooves 3 and spiral fins 4 are formed at an inner surface.

When such heat transfer pipe 1 with grooved inner surface is used, a surface area in the pipe becomes large, so that a heat transfer area can be increased. In addition, high evaporation heat transfer coefficient and condensation heat transfer coefficient can be provided by acceleration of turbulent flow effect and reduction in refrigerant liquid film thickness in accordance with the addition of the spiral fins. Therefore, performance of the refrigerating machine, air conditioning device, heat pump, etc. can be improved.

In late years, this kind of heat transfer pipe with grooved inner surface has been developed to have a groove shape with an improved vaporization property, by adding one or more fins having a fin height lower than the spiral fin positioned in a space between the spiral fins to keep the liquid film thin. For example, Japanese Patent Laid-Open No. 2002-350080 (JP-A-2002-350080) proposes such a heat transfer pipe with grooved inner surface. FIGS. 2A and 2B are schematic illustrations showing another conventional heat transfer pipe with grooved inner surface having low fins and high fins, wherein FIG. 2A is a cross sectional view of the heat transfer pipe cut along a line perpendicular to a pipe axis line, and FIG. 2B is an enlarged cross sectional view showing a part A shown in FIG. 2A.

In FIGS. 2A and 2B, a heat transfer pipe 10 with grooved inner surface comprises a pipe body 11, high fins 12*a*, and low fins 13*a*, and a whole structure is made of copper pipe. At an inner surface of the pipe body 11 (outer diameter of 7 mm, and a groove bottom wall thickness of 0.25 mm), the high fins 12*a* with a fin height of 0.2 mm and a torsion angle of 16° are formed. The number of the high fins is 50. At a groove bottom of a spiral groove 12*b*, two peaks of the low fins 13*a* with a fin height of 0.03 mm are formed between the adjacent high fins 12*a*. In FIG. 2B, HF is a fin height of the high fin 12*a* and hf is a fin height of low fin 13*a*.

By using such heat transfer pipe 10 with grooved inner surface, a surface area increases more than the conventional heat transfer pipe with grooved inner surface, and thin liquid film can be formed by the presence of the low fin 13*a*, so that the vaporization property can be improved.

However, according to the heat transfer pipe with grooved inner surface proposed by JP-A-2002-350080, the fin height Hf of the high fin 12*a* is 0.2 mm and the fin height hf of the low fin 13*a* is 0.03 mm in the pipe body 11, so that a fin height ratio (the fin height hf of low fin/the fin height Hf of high fin) is 0.15. As shown FIG. 3, compared with the conventional heat transfer pipe with grooved inner surface (i.e. heat transfer pipe without low fin 13*a*), the evaporation heat transfer coefficient is greater by 1.08 times while the condensation heat transfer coefficient is slightly decreased to 0.98 times. If the fin height ratio becomes larger, the condensation heat transfer coefficient will be deteriorated. When the fin height ratio is 0.25, the condensation heat transfer coefficient is deteriorated to 0.8 times, and the evaporation heat transfer coefficient is greater by 1.1 times, i.e. a proportion of augmentation is low. As described above, in the conventional heat transfer pipe with grooved inner surface with the outer diameter of 7 mm having the high fins 12*a* with the torsion angle of 16°, the ratio of the performance improvement resulted from the addition of the low fins is low. Namely, in the heat transfer pipe 10 with grooved inner surface having the high fins 12*a* and the low fins 13*a*, the improvement in the evaporation heat transfer coefficient can be observed. However, the improvement in performance is small (less than 10%) and the condensation heat transfer coefficient is significantly reduced in accordance with the increase of the fin height ratio.

Accordingly, the Inventors of the present invention studied effect of the fin height ratio (the fin height of the low fin/the fin height of the high fin) on the ratio of the heat transfer coefficient (the evaporation heat transfer coefficient/the condensation heat transfer coefficient), and the effect of a product (P) of a inner diameter di (mm) of the pipe body, a bottom width W (mm) of a spiral groove and a sinusoidal value of a torsion angle β of the spiral groove (i.e. $P=W\times di\times \sin\beta$) on the ratio of the evaporation heat transfer coefficient. In the process of analyzing effect of changing the fin height Hf of the high fin, the fin height hf of the low fin, the inner diameter di of the pipe body, the bottom width W (mm) of the spiral groove and the torsion angle β of the spiral groove, the Inventors found that the evaporation heat transfer coefficient can be largely improved and the reduction of the condensation heat transfer coefficient can be suppressed, when the fin height hf (mm) and the torsion angle α (°) of the low fin are determined respectively to satisfy the following conditions:

$$Hf/15 \leqq hf \leqq Hf/3 \text{ and } \alpha=\beta,$$

when $P=W\times di\times \sin\beta$ ($P\geqq 0.86$) wherein the bottom width of the spiral groove is W (mm), the torsion angle of the spiral groove is β (°), and the inner diameter of the pipe body is di (mm).

SUMMARY OF THE INVENTION

Accordingly, it is an object of the invention to provide a heat transfer pipe with groove inner surface, by which an evaporation heat transfer coefficient can be largely improved and reduction of a condensation heat transfer coefficient can be suppressed.

According to a feature of the invention, a heat transfer pipe with grooved inner surface, comprises:

a pipe body having a pipe axis line as a center axis line;

a plurality of first fins having a predetermined fin height Hf, the first fins being formed by providing a plurality of spiral grooves at an inner surface of the pipe body along the pipe axis line; and a second fin provided at a bottom of at least one of the spiral grooves;

wherein the fin height hf and a torsion angle α of the second fin are determined respectively to satisfy following condition:

$$Hf/15\leqq hf\leqq Hf/3 \text{ and } \alpha=\beta,$$

when $P=W\times di\times \sin\beta$ and $P\geqq 0.86$ wherein a bottom width of the spiral groove is W, a torsion angle of the spiral groove is β, and an inner diameter of the pipe body is di.

In the heat transfer pipe with grooved inner surface, the number of the second fins may be equal to the number of first fins.

In the heat transfer pipe with grooved inner surface, the number of the second fins may be less than the number of first fins.

In the heat transfer pipe with grooved inner surface, the number of the second fins may be more than the number of first fins.

In the heat transfer pipe with grooved inner surface, an outer diameter do of the pipe body may be equal to or more than 7.9 mm, and the torsion angle β of the spiral groove may be equal to or more than 25°.

According to the present invention, the evaporation heat transfer coefficient can be largely improved, and the reduction of the condensation heat transfer coefficient can be suppressed.

BRIEF DESCRIPTION OF THE DRAWINGS

Preferred embodiment according to the invention will be described in conjunction with appended drawings, wherein:

FIGS. 1A to 1C are schematic illustrations showing a conventional heat transfer pipe for in-pipe evaporation/condensation (heat transfer pipe with grooved inner surface), wherein FIG. 1A is a cross sectional view of the heat transfer pipe including a pipe axis line (virtual axis), FIG. 1B is a cross sectional view of the heat transfer pipe cut along a line perpendicular to the pipe axis line, and FIG. 1C is an enlarged cross sectional view showing a part A shown in FIG. 1B;

FIGS. 2A and 2B are schematic illustrations showing another conventional heat transfer pipe with grooved inner surface having low fins and high fins, wherein FIG. 2A is a cross sectional view of the heat transfer pipe cut along a line perpendicular to a pipe axis line, and FIG. 2B is an enlarged cross sectional view showing a part A shown in FIG. 2A;

FIGS. 4A and 4B are schematic illustrations of a heat transfer pipe with grooved inner surface in a preferred embodiment according to the invention, wherein FIG. 4A is a cross sectional view of the heat transfer pipe cut along a line perpendicular to a pipe axis line, and FIG. 1B is an enlarged cross sectional view of a part B shown in FIG. 1A;

DETAILED DESCRIPTION OF PREFERRED EMBODIMENT

Next, a heat transfer pipe with grooved inner surface in the preferred embodiment according to the present invention will be explained in more detailed in conjunction with the appended drawings.

Figure 1A:
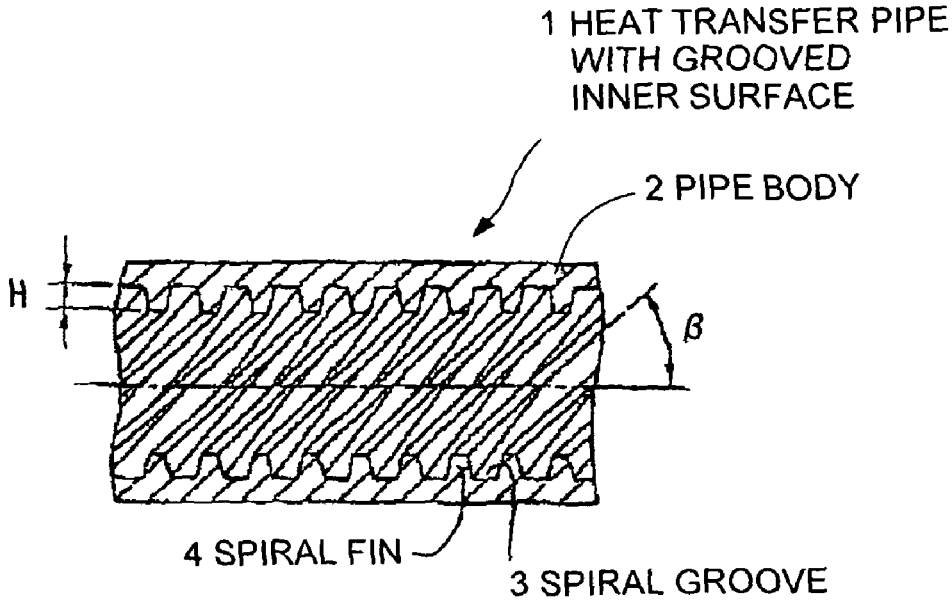
FIG. 1A PRIOR ART
Figure 1B:
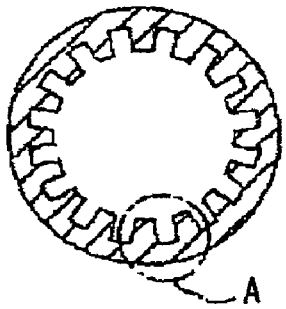
FIG. 1B PRIOR ART
Figure 4A:
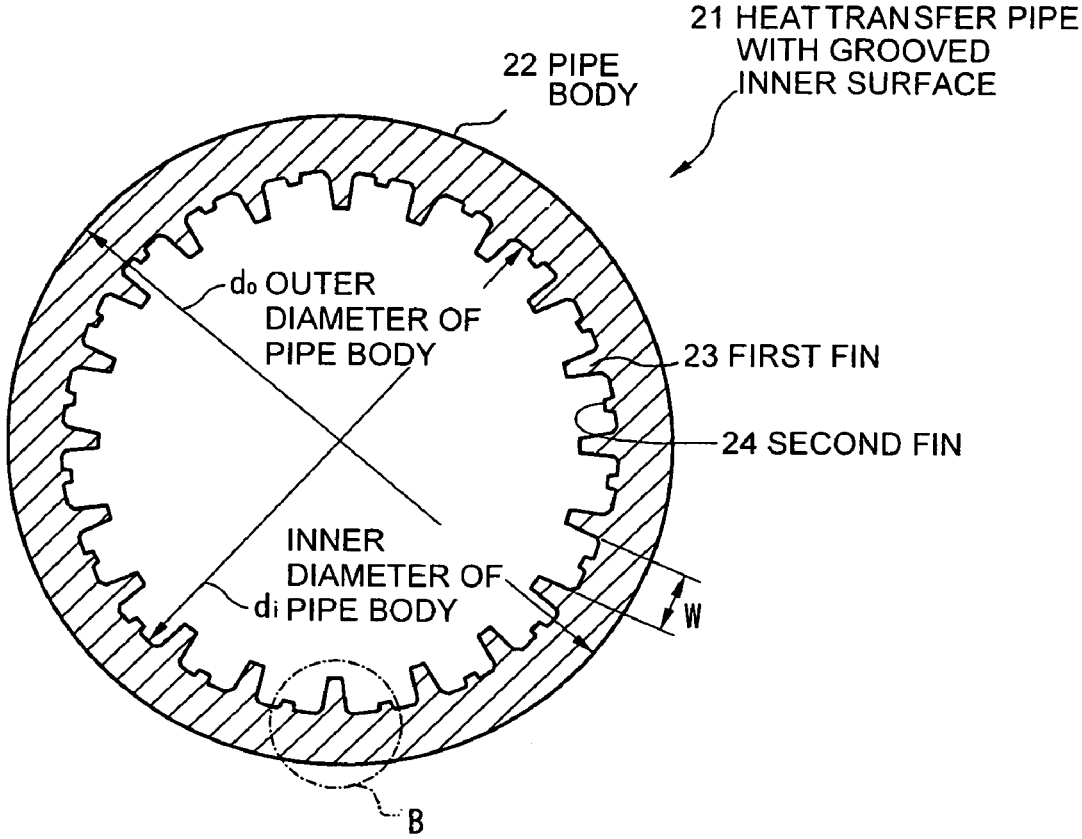
Figure 4B:
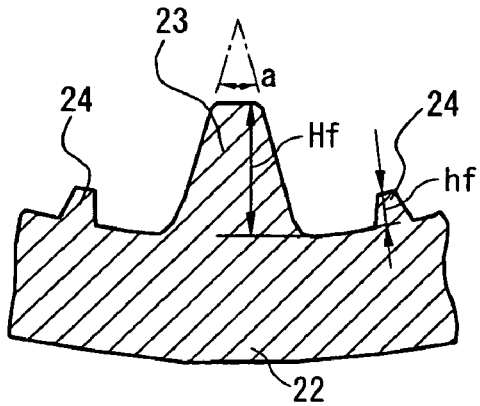

FIGS. 4A and 4B are schematic illustrations of a heat transfer pipe with grooved inner surface in the preferred embodiment according to the invention, wherein FIG. 4A is a cross sectional view of the heat transfer pipe cut along a line perpendicular to a pipe axis line, and FIG. 1B is an enlarged cross sectional view of a part B shown in FIG. 1A.

In FIGS. 4A and 4B, a heat transfer pipe 21 with grooved inner surface comprises a pipe body 22 having a pipe axis line ○ (virtual axis line) as a center axis line, first fins 23 and second fins 24, and a whole structure is made of, for example, copper pipe. The first fins 23 are high fins and the second fins 24 are low fins, and the fin heights thereof are different from each other. In the pipe body 22, an inner diameter di and an outer diameter di are respectively determined as di=8.92 mm, and do=9.52 mm, and a wall thickness of a groove bottom is 0.30 mm.

As for the first fin (high fin) 23, the first fin 23 is a projection having an approximately trapezoidal cross section with an apex angle α ($0<a<90°$), and the first fins 23 are formed by providing a plurality of spiral grooves 200 (The number of grooves is 55) at the inner surface of the pipe body 22 along the pipe axis line ○. For example, the fin height Hf of the first fin 23 is set as Hf=0.18 mm, a torsion angle β is set as β=35°, and a fin number N is set as N=55.

The second fin (low fin) 24 is positioned between the two first fins 23 adjacent to each other among the first fins 23 the number of which is 55, at a bottom of each of spiral grooves 200 the number of which is 55. The second fin 23 is a projection having an approximately trapezoidal cross section with an apex angle α (0<a<90°), similarly to the first fin 23. The fin height hf (mm) and the torsion angle α (°) of the second fin 24 are determined respectively to satisfy the following conditions:

$$Hf/15 \leqq hf \leqq Hf/3 \text{ and } \alpha=\beta,$$

when P=W×di×sin β (P≧0.86) wherein the bottom width of the spiral groove 200 (the first fin 23) is W (mm), the torsion angle of the spiral groove 200 (the first fin 23) is β (°), and the inner diameter of the pipe body 22 is di (mm). For example, the fin height hf of the second fin 24 is set as hf=0.03 mm, a fin number n is set as n=55, and a torsion angle α is set as α=35°, respectively.

Figure 5:
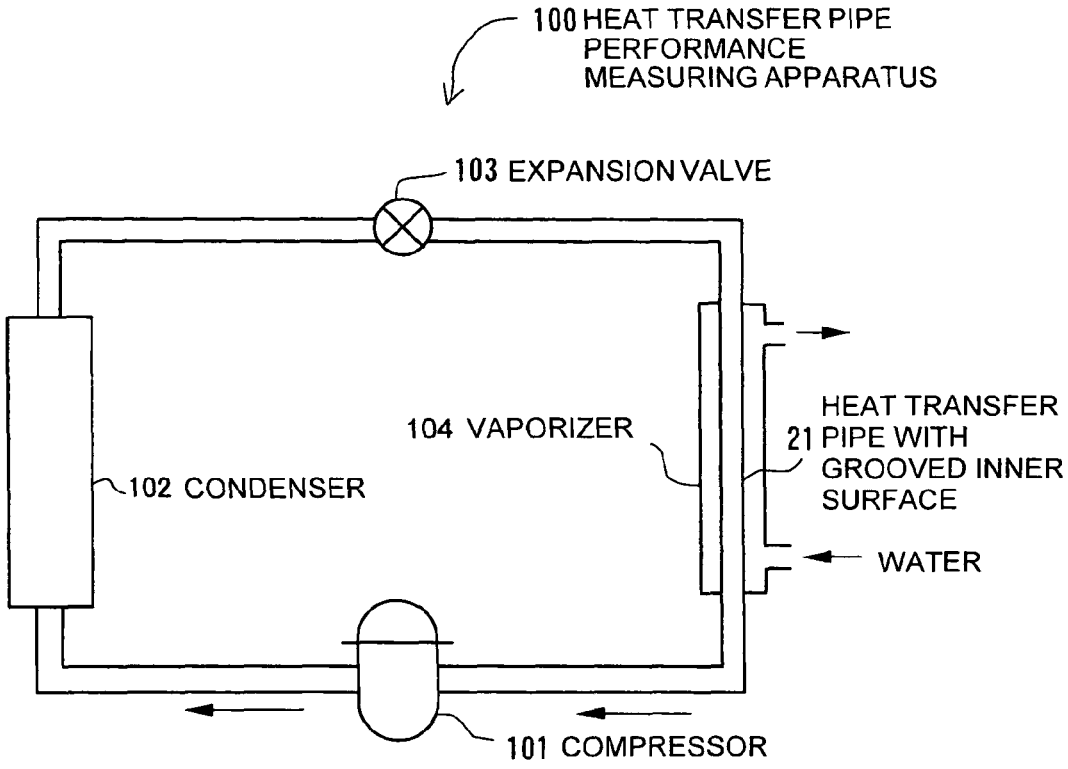
FIG. 5 is a schematic illustration showing an apparatus for measuring heat transfer pipe performance.

FIG. 5 is a schematic illustration of an apparatus for measuring a heat transfer pipe performance.

In FIG. 5, a heat transfer pipe performance measuring apparatus 100 comprises a compressor 101 for compressing refrigerant vapor, a condenser 102 for condensing the refrigerant vapor compressed by the compressor 101 to provide refrigerant liquid, and an expansion valve 103 for depressurizing the refrigerant liquid provided from the condenser 102, and a vaporizer 104 for evaporating the refrigerant liquid depressurized by the expansion valve 103 to provide refrigerant gas.

For measuring the evaporation heat transfer coefficient by using the heat transfer pipe performance measuring apparatus 100, the heat transfer pipe 21 with grooved inner surface shown in FIGS. 4A and 4B is incorporated in the vaporizer 104 as shown in FIG. 5 to provide an effective length of 3000 mm. The vaporizer 104 is construed with a double pipe structure, in which water is drained outside the heat transfer pipe 21 with grooved inner surface, such that the refrigerant in the heat transfer pipe 12 with grooved inner surface is vaporized. On the other hand, for measuring the condensation heat transfer coefficient, the heat transfer pipe 21 with grooved inner surface is incorporated in the condenser 102.

Figure 1C:
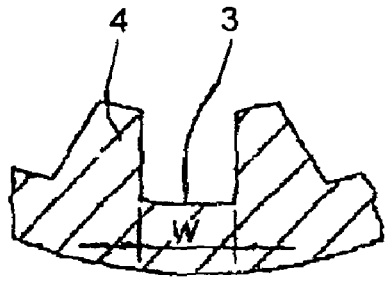
FIG. 1C PRIOR ART
Figure 2A:
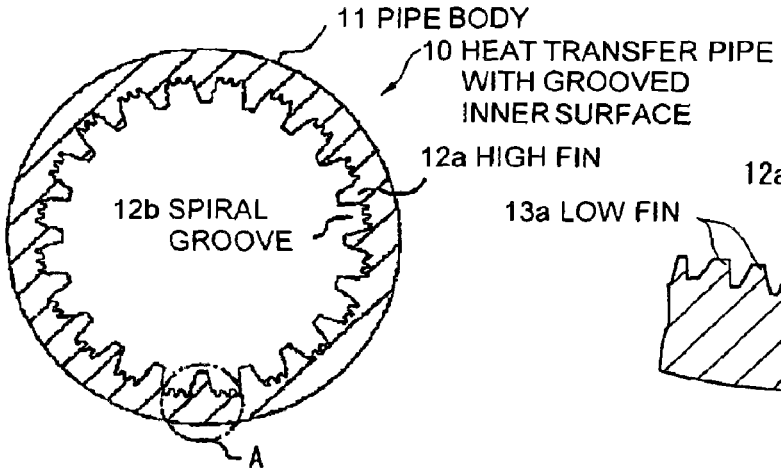
FIG.2A PRIOR ART
Figure 2B:
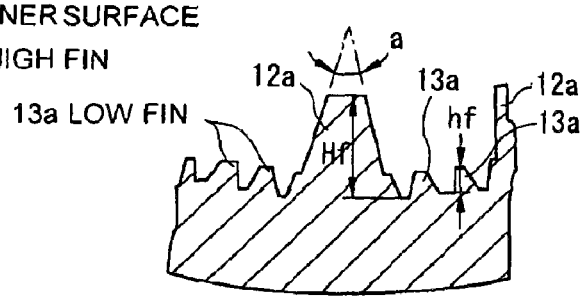
FIG.2B PRIOR ART
Figure 3:
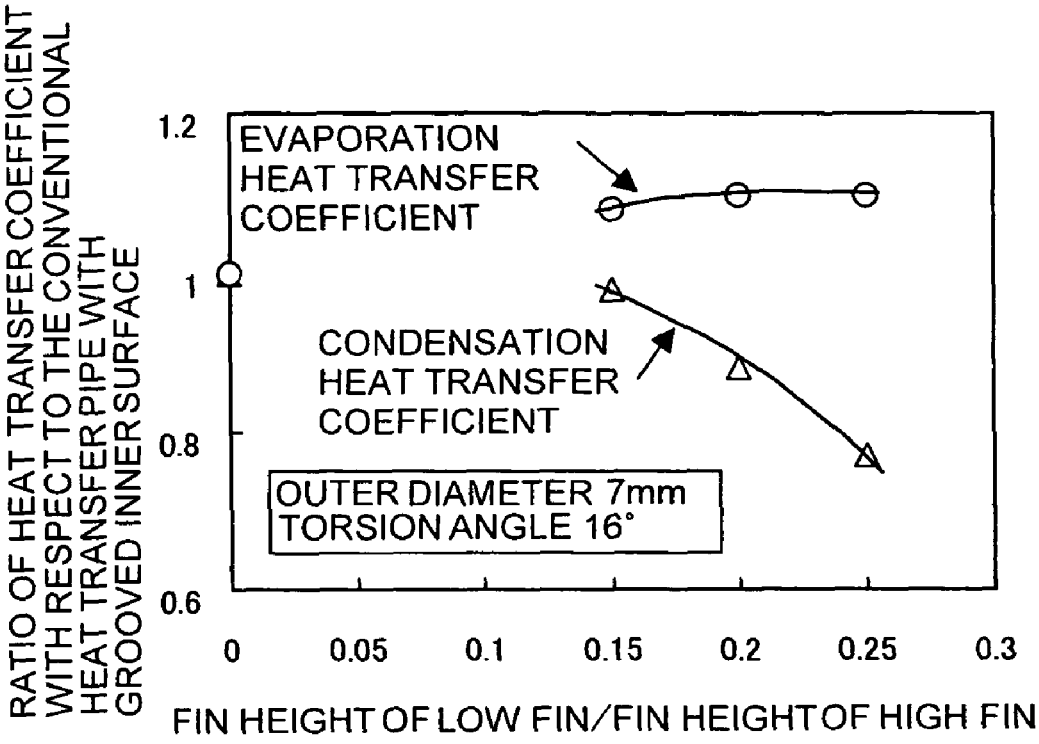
FIG.3 PRIOR ART
FIG. 3 is a graph showing a relationship between a fin height ratio and heat transfer coefficients in the heat transfer pipe with grooved inner surface shown in FIGS. 2A and 2B.

When remarking with behavior of the refrigerant liquid in respective grooves in the conventional heat transfer pipe with grooved inner surface as shown in FIG. 1, it is assumed that a wettability inside the heat transfer pipe is determined by a relationship between the surface tension and the gravitation. When the heat transfer pipe with grooved inner surface is installed such that the pipe axis line is positioned in perpendicular to a gravitation direction of the heat transfer pipe with grooved inner surface, the surface tension increases if the inner diameter of the heat transfer pipe is small and the bottom width of the groove is small, so that the inside of the heat transfer pipe tends to get wet with the refrigerant liquid. When the torsion angle is large, the refrigerant liquid tends to flow in the gravitation direction along the grooves, so that the inside (particularly an upper portion) of the heat transfer pipe tends to get dry.

In this preferred embodiment, R410A is used for the refrigerant. In an evaporation experiment, an inlet drying temperature is 0.2° C., an outlet saturation temperature is 12.0° C., and an outlet heating temperature is 2° C. for the vaporizer 104. In a condensation experiment, an inlet heating temperature is 22.5° C., an inlet saturation temperature is 40° C., and an outlet cooling temperature is 5° C. for the condenser 102. Detailed specification of the heat transfer pipe is determined as shown in Tables 1 and 2. The following measurement is conducted.

Figure 6:
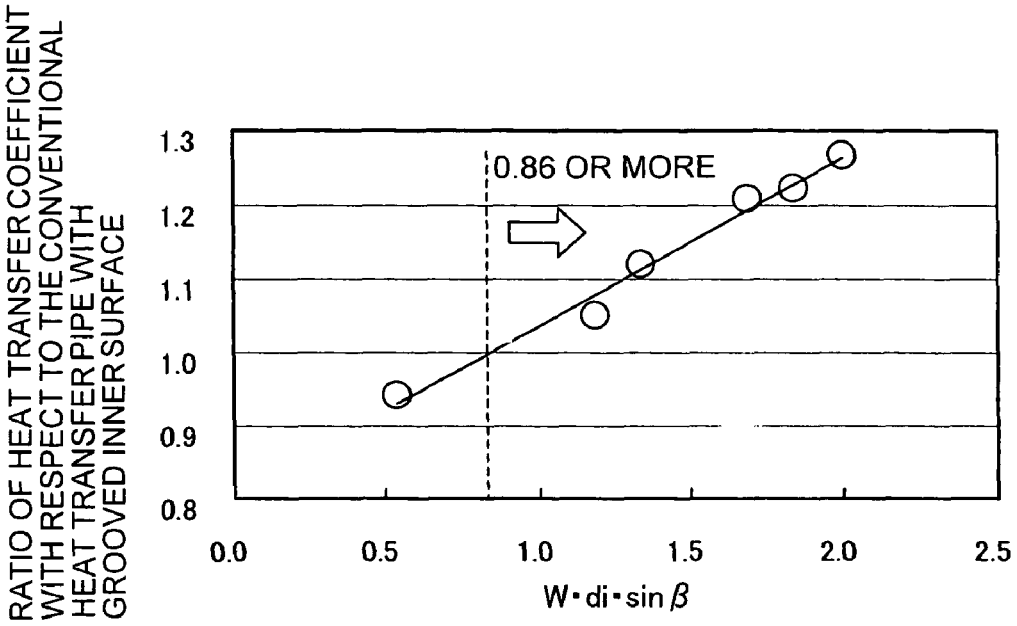
FIG. 6 is a graph showing a relationship between a ratio of heat transfer coefficients and $P=W\times di\times \sin\beta$ of the heat transfer pipe with grooved inner surface in the preferred embodiment according to the invention.

FIG. 6 is a graph showing a result of effects of a product (P=W×di×sin β) of the groove bottom width W (W=0.27 to 0.41 mm), the pipe inner diameter di (di=6.5 to 8.46 mm) and sin β (torsion angle β=18 to 40°) in the heat transfer pipe with an outer diameter do (do=7 to 9.52 mm) on the evaporation heat transfer coefficient ratio by using the heat transfer pipe performance measuring device 100 shown in FIG. 5. In FIG. 6, the evaporation heat transfer coefficient ratio in the conventional heat transfer pipe with grooved inner surface is indicated by a vertical axis and P=W×di×sin β is indicated by a horizontal axis, respectively. The pipe inner diameter di is an inner diameter with respect to the groove bottom. Herein, the "evaporation heat transfer coefficient ratio compared with the conventional heat transfer pipe with grooved inner surface" is a performance ratio of "an evaporation heat transfer coefficient of the heat transfer pipe with grooved inner surface having the first (high) fins and the second (low) fins according to the present invention" and "an evaporation heat transfer coefficient of the conventional heat transfer pipe with grooved inner surface of similar specification excluding the second fins". In addition, the evaporation heat transfer coefficient ratio at the refrigerant flow of 30 kg/h is shown.

As is apparent from FIG. 6, even if the second fins are added, the vaporization property improvement cannot be expected when P=W×di×sin β is small. However, if P becomes large, the effect of improving the vaporization property will be increased. It is because that the effect of the surface tension will be large when P is small, and the effect of the surface tension will be small when P is large. It is assumed from FIG. 6 that the vaporization property will be improved by adding the low fins when W×di×sin β is equal to or more than 0.86 (i.e. P≧0.86).

On the other hand, P=W×di×sin β is preferably less than 10. For example, in the heat transfer pipe with the outer diameter do (do=7.9) wherein P=W×di×sin β>10, the number of the first fins (high fins) in the heat transfer pipe will be less than 10 so that the effect of increasing the surface area by providing the fins in the heat transfer pipe will be reduced.

Figure 7:
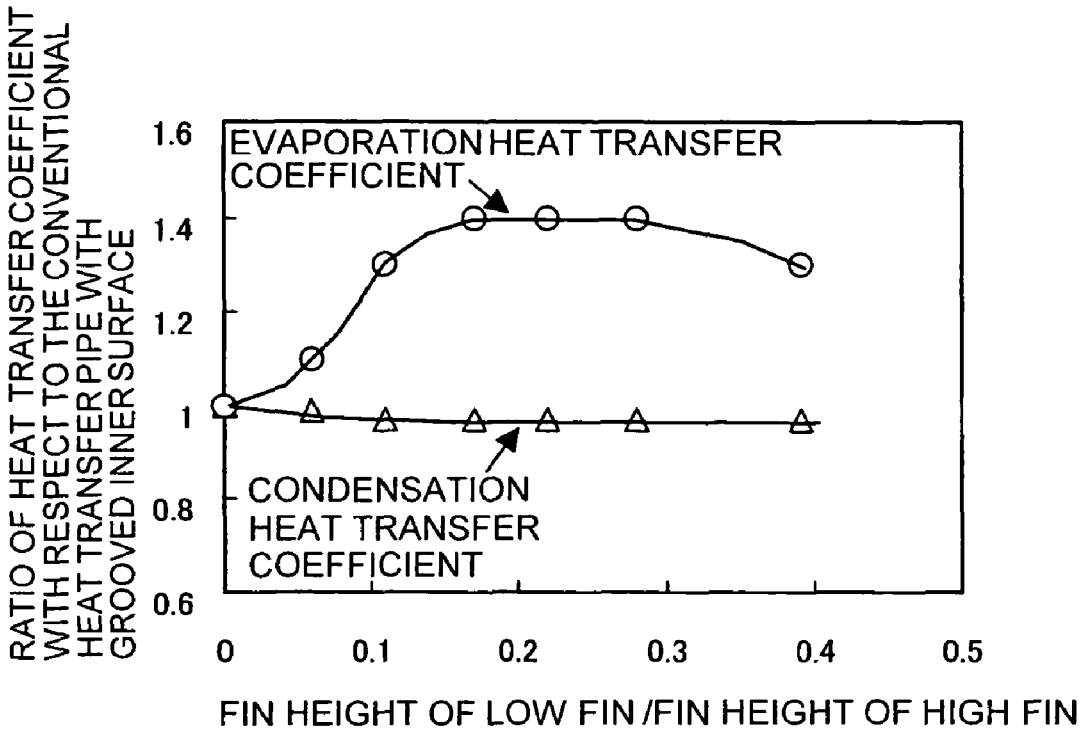
FIG. 7 is a graph showing a relationship between a fin height ratio and the ratio of the heat transfer coefficients of the heat transfer pipe with grooved inner surface in the preferred embodiment according to the invention.

FIG. 7 is a graph showing a result of the effect of the fin height ratio of the first fin and the second fin on the condensation/evaporation heat transfer coefficient. In FIG. 7, the performance ratio with respect to the conventional heat transfer pipe with grooved inner surface is indicated by a vertical axis and a fin height ratio (hf/Hf, the fin height hf of the second fin/the fin height Hf of the first fin) is indicated by a horizontal axis. Herein, the conventional heat transfer pipe with grooved inner surface is the heat transfer pipe with grooved inner surface in which the fin height ratio of the first fin and the second fin is 0, namely the heat transfer pipe with grooved inner surface having only the first fins. In addition, the evaporation heat transfer coefficient ratio at the refrigerant flow of 30 kg/h is shown.

As is apparent from FIG. 7, the fin height ratio is about 0.17 in the heat transfer pipe with grooved inner surface in this preferred embodiment (the fin height Hf of the first fin is set as Hf=0.18 mm and the fin height hf of the second fin is set as hf=0.03 mm). Compared with conventional heat transfer pipe with grooved inner surface, the evaporation heat transfer coefficient is greater by 1.4 times, and the condensation heat transfer coefficient is greater by 0.97 times.

If the fin height ratio is less than 1/15, the improvement in the evaporation heat transfer coefficient will be small. On the other hand, if the fin height ratio exceeds 1/3, an augmentation of weight due to addition of the second fins will be equal to or more than 4%, so that fabrication cost will be increased in accordance with the increase in weight of the heat transfer pipe. Therefore, it is preferable that the fin height ratio is equal to more than 1/15 and equal to or less than 1/3 (i.e. Hf/15≦hf≦Hf/3).

Figure 8:
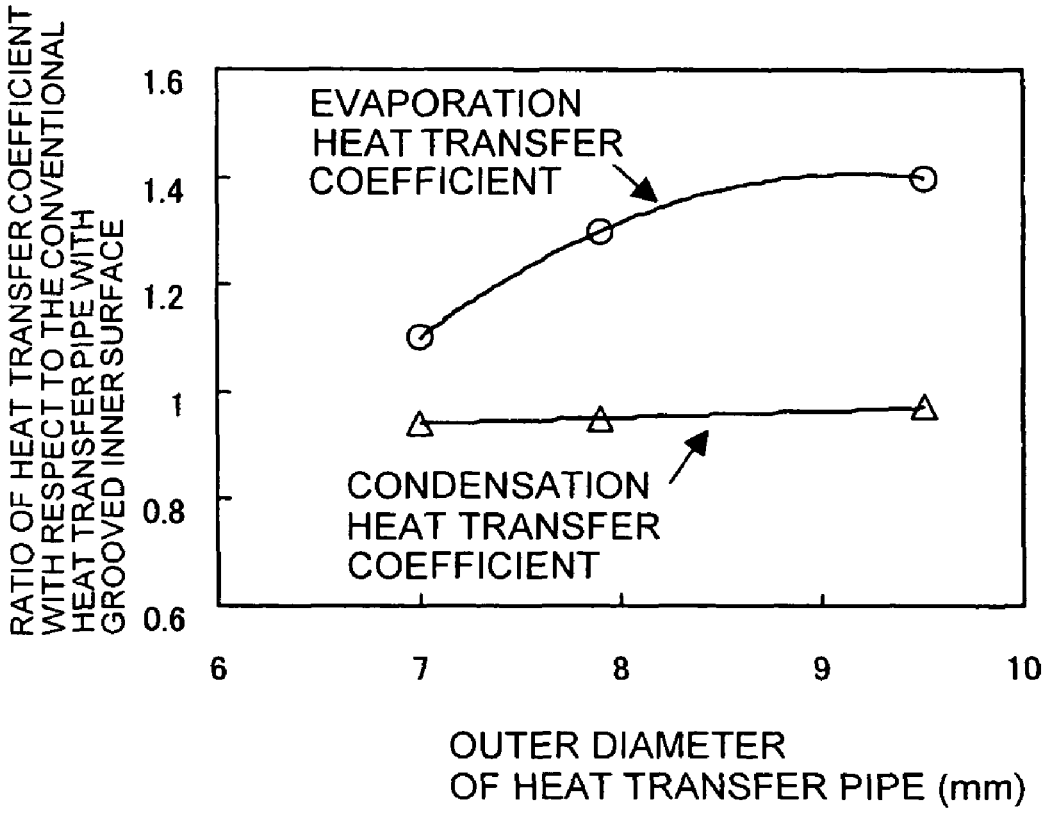
FIG. 8 is a graph showing a relationship between an outer diameter and the ratio of the heat transfer coefficients of the heat transfer pipe with grooved inner surface in the preferred embodiment according to the invention.

FIG. 8 is a graph showing a result of effect of the outer diameter of the heat transfer pipe on the condensation/evaporation heat transfer coefficient. In FIG. 8, the performance ratio with respect to the conventional heat transfer pipe with grooved inner surface is indicated by a horizontal axis and the outer diameter of the heat transfer pipe is indicated by a vertical axis.

The detailed specification of the heat transfer pipe with grooved inner surface is shown in Table 1. As is apparent from FIG. 8, the evaporation heat transfer coefficients are 110%, 130%, and 140% in the heat transfer pipes with an outer diameter of 7 mm, 7.94 mm, and 9.52 mm, respectively, namely, the evaporation heat transfer coefficient is increased in accordance with increase of the outer diameter. Accordingly, it is preferable that the outer diameter is equal to or more than 7.9 mm.

Figure 9:
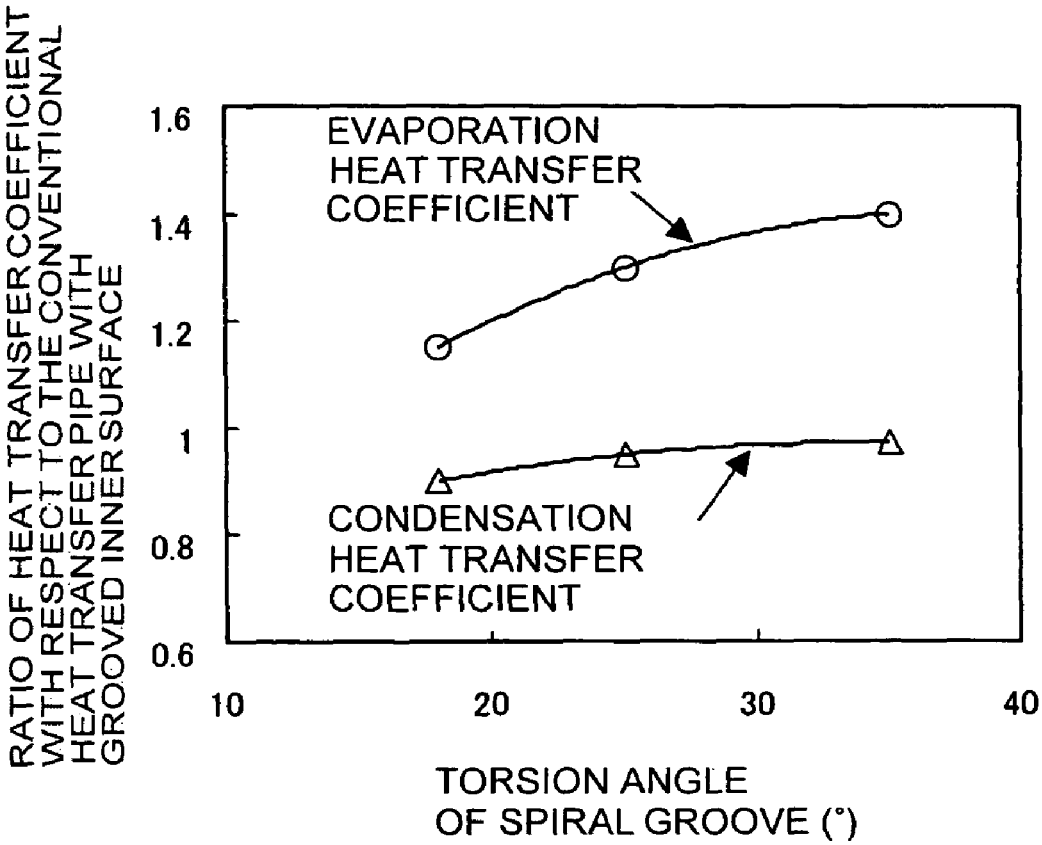
FIG. 9 is a graph showing a relationship between a torsion angle and the ratio of the heat transfer coefficients of the heat transfer pipe with grooved inner surface in the preferred embodiment according to the invention.

FIG. 9 is a graph showing a result of the effect on the condensation/evaporation heat transfer coefficient. In FIG. 9, a performance ratio with respect to the conventional heat transfer pipe with grooved inner surface is indicated by a vertical axis and the torsion angle β of the spiral groove is indicated by a horizontal axis. The detailed specification of the heat transfer pipe with grooved inner surface except the torsion angle β is similar to that of the heat transfer pipe with grooved inner surface with an outer diameter of 9.52 mm shown in Table 2.

As is apparent from FIG. 9, the evaporation heat transfer coefficients are 115%, 130%, and 140% in the heat transfer pipes with a torsion angle β of 18°, 25°, and 35°, respectively. Namely, the evaporation heat transfer coefficient is increased in accordance with increase of the torsion angle β. Accordingly, it is preferable that the torsion angle β is equal to or more than 25°.

Therefore, it is confirmed from the above measurement that the reduction in the condensation heat transfer coefficient can be suppressed and the improvement in the evaporation heat transfer coefficient can be increased by adding the second fins 24, when the outer diameter do is set as do≧7.9 mm and the torsion angle β of the spiral groove 200 is set as β≧25°.

TABLE 1

| | | Bottom | High fin | | | Low fin | |
|---|---|---|---|---|---|---|---|
| No. | Outer diameter (mm) | thickness (mm) | Fin height (mm) | Torsion angle (°) | Fin number | Fin height (mm) | Peak number |
| 1 | 7.0 | 0.25 | 0.18 | 30 | 40 | 0.03 | 40 |
| 2 | 7.9 | 0.26 | 0.18 | 30 | 50 | 0.03 | 50 |
| 3 | 9.5 | 0.28 | 0.18 | 35 | 55 | 0.03 | 55 |

TABLE 2

| | | Bottom | High fin | | | Low fin | |
|---|---|---|---|---|---|---|---|
| No. | Outer diameter (mm) | thickness (mm) | Fin height (mm) | Torsion angle (°) | Fin number | Fin height (mm) | Peak number |
| 1 | 9.52 | 0.28 | 0.18 | 35 | 60 | 0.03 | 40 |
| 2 | 8 | 0.26 | 0.18 | 30 | 50 | 0.03 | 25 |

According to the preferred embodiment, following effects can be obtained.

the evaporation heat transfer coefficient can be largely improved and the reduction of the condensation heat transfer coefficient can be suppressed, when the fin height hf (mm) and the torsion angle α (°) of the second fin 24 are determined respectively to satisfy the following conditions:

$$Hf/15 \leqq hf \leqq Hf/3 \text{ and } \alpha=\beta,$$

when P=W×di×sin β and P≧0.86 (mm$^2$) wherein the bottom width and the torsion angle of the spiral groove 200 is W (mm) and β (°), and the inner diameter of the pipe body 22 is di (mm).

The heat transfer pipe with grooved inner surface according to the present invention is explained based on the preferred embodiment, however, the present invention is not limited thereto and can be carried out in various kinds of aspects within a scope of the invention. For example, following variations are also possible.

In the preferred embodiment, only one second fin 24 is disposed at respective groove bottoms of the spiral grooves 200 (the number of the spiral grooves 200 is 55), however, the present invention is not limited thereto.

Figure 10:
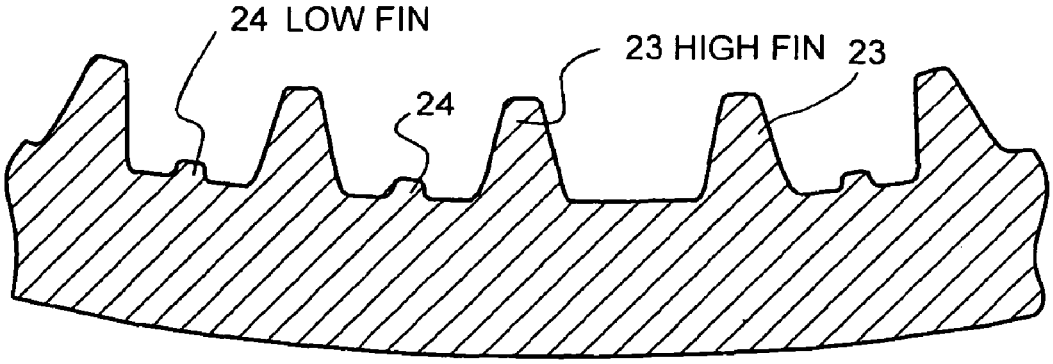
FIG. 10 is a cross sectional view showing a first variation of the heat transfer pipe with grooved inner surface in the preferred embodiment according to the invention.

FIG. 10 is a cross sectional view showing the first variation of the heat transfer pipe with grooved inner surface according to the present invention. As shown in FIG. 10, the second fins 24 may not be provided at every groove bottoms. Namely, the second fin 24 is provided only particular groove bottoms of the spiral grooves 200.

Figure 11:
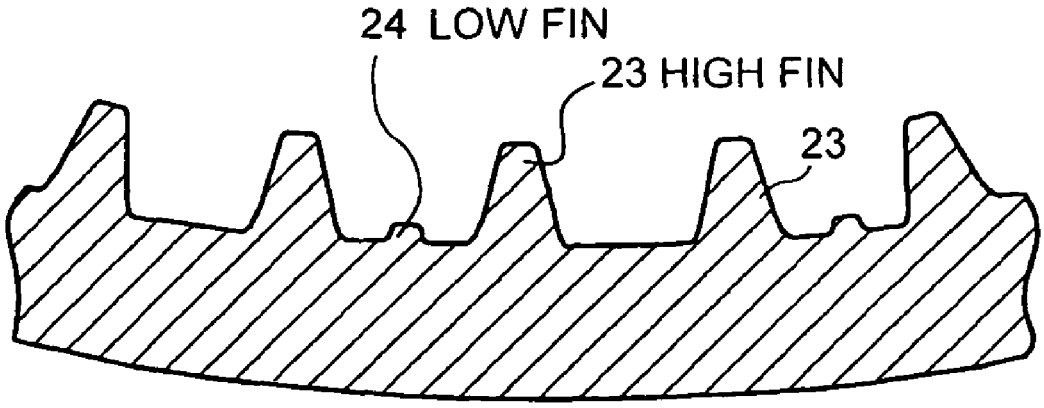
FIG. 11 is a cross sectional view showing a second variation of the heat transfer pipe with grooved inner surface in the preferred embodiment according to the invention.

FIG. 11 is a cross sectional view showing the second variation of the heat transfer pipe with grooved inner surface. As shown in FIG. 11, the second fins 24 may be provided only particular groove bottoms of the spiral grooves 200. Further, the number of the second fins 24 provided at the groove bottom is not limited to singular.

In other words, according to the present invention, it is sufficient that at least a second fin 24 is provided at a groove bottom of at least one spiral groove 200.

Concerning the number of the first and second fins, the number of the second fins may be equal to the number of first fins. The number of the second fins may be more than the number of first fins. When the number of the second fins is equal to or more than the number of the first fins, almost similar effect of improving the evaporation can be expected.

Further, the number of the second fins may be less than the number of first fins. In this case, the effect of improving the evaporation is proportional to the number of the second fins. For example, when the number of the first fins and the number of the second fins are same and the effect of improving the evaporation is about 20%, if the number of the second fins is decreased to the half, the effect of improving the evaporation will be about 10%. However, in any case, the effect of improving the evaporation will be obtained.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A heat transfer pipe with a grooved inner surface, comprising:

a pipe body having a pipe axis line as a center axis line;

a plurality of first fins, each of the first fins having a fin height Hf;

a plurality of spiral grooves, wherein each of the spiral grooves is provided by adjacent first fins at an inner surface of the pipe body along the pipe axis line; and a second fin provided at a bottom of at least one of the spiral grooves;

wherein a fin height hf and a torsion angle α of the second fin are determined, respectively, to satisfy the following condition:

$$Hf/15 \leqq hf \leqq Hf/3,$$

$$\alpha=\beta$$

$$P=W\times di\times \sin\beta \text{ and}$$

$$P\geqq 1.69, \text{mm}^2 \text{ and}$$

wherein a bottom width of the spiral groove provided by the adjacent first fins is W, a torsion angle of a first fin is β, and an inner diameter of the pipe body is di.

2. The heat transfer pipe with the grooved inner surface according to claim 1, wherein a number of the second fins is equal to a number of the first fins.

3. The heat transfer pipe with the grooved inner surface according to claim 1, wherein a number of the second fins is less than a number of the first fins.

4. The heat transfer pipe with the grooved inner surface according to claim 1, wherein a number of the second fins is more than a number of the first fins.

5. The heat transfer pipe with the grooved inner surface according to claim 1, wherein an outer diameter do of the pipe body is equal to or more than 7.9 mm, and the torsion angle θ of the first fin is equal to or more than 25°.

6. The heat transfer pipe with the grooved inner surface according to claim 5, wherein the height Hf of the first fin is 0.18 mm and the height hf of the second fin is 0.03 mm.

* * * * *